United States Patent [19]

Trolle

[11] 3,931,728

[45] Jan. 13, 1976

[54] PORTAL PRESS

[75] Inventor: Sten Trolle, Ystad, Sweden

[73] Assignee: AB Carbox, Ystad, Sweden

[22] Filed: Feb. 14, 1974

[21] Appl. No.: 442,416

[30] Foreign Application Priority Data

Feb. 27, 1973 Sweden ..... 7302712

[52] U.S. Cl. ..... 72/455; 72/447; 72/453; 100/214

[51] Int. Cl.[2] ..... B21J 13/04

[58] Field of Search ..... 72/455, 453, 447, 446, 72/448; 100/214, 269

[56] References Cited

UNITED STATES PATENTS

| | | | |
|---|---|---|---|
| 1,137,132 | 4/1915 | Gross | 72/447 |
| 1,585,212 | 5/1926 | Schranz | 72/455 |
| 2,376,853 | 5/1945 | Miller | 72/447 |
| 3,024,676 | 3/1962 | Howahr | 72/453 |
| 3,134,350 | 5/1964 | Danly | 72/446 |
| 3,427,854 | 2/1969 | Michelson | 72/448 |
| 3,508,429 | 4/1970 | Staples | 72/455 |
| 3,717,024 | 2/1973 | Davison | 72/455 |
| 3,747,393 | 7/1973 | Robra | 72/455 |

*Primary Examiner*—C. W. Lanham
*Assistant Examiner*—Gene P. Crosby
*Attorney, Agent, or Firm*—Flynn & Frishauf

[57] ABSTRACT

In a hydraulic press for heavy workpieces the frame of which comprises two yokes spaced by columns, the yokes are movable towards and from each other by the hydraulic working cylinders of the press. At least one of the yokes carries tools displaceable along the yoke. The arrangement makes it possible for the tools to work on every portion of a workpiece filling out the entire space between the columns, yet the cylinders are fixed relatively to the yoke carrying them which eliminates the need for flexible connections for the hydraulic medium.

4 Claims, 7 Drawing Figures

III
III

PORTAL PRESS

The present invention relates generally to so-called portal presses and, more specifically, to hydraulic presses designed to operate on heavy workpieces and equipped with a frame comprising two yokes which are spaced by columns at their both ends and carry the press tools between themselves.

Very heavy workpieces, particularly sheet metal pieces, are subjected to pressing in many fields of the engineering industry. Their main dimensions could typically be of the order of magnitude of 15 × 30 ft. and the working carried out involves plastic deformation to a larger or smaller extent and in different ways. A general object of the deformation is, however, to give the metal pieces a curvature in one or two planes. Typical fields of use for both categories are, by way of example, ship hull plates, walls for cylindrical or spherical containers and pressure vessels etc. In those connections there arise very considerable handling problems, which, on the one hand, are a consequence of the heavy weights and dimensions of the workpieces and, on the other, emanate from the structural and operational limitations of the machinery used.

An obvious but naturally also very expensive solution of the handling problem is to design portal presses of very large dimensions. This would, if the press was required to handle plates with the maximum dimensions 15 × 30 ft., mean that the available space between the columns of the press frame must be 30 ft., since the machine must satisfy the requirement that any portion of the workpiece shall be within the reach of the centrally located tool of the press. Stated in other words, this requirement implies that it must be possible laterally to displace the plate by a distance equal to its full width. Further, it is obviously necessary to allow for longitudinal displacement of the workpiece through the portal by a distance equal to the total length of the workpiece. The combination of those two requirements involves that the workpiece must be positively controlled in two co-ordinate directions. However, an arrangement capable of co-ordinate adjustment of a heavy workpiece within a large area and at a high precision, naturally becomes very big but, above all, very expensive. While it is true that the use of gap presses reduces the overall size of the press as well as the maneuvering area called for by the handling apparatus, the latter must in return also be capable of turning the plate upside down, which means that it acts as a manipulator. Consequently, also such a solution is very expensive.

It would per se be possible to solve the problem of availability in different ways for each of the two coordinate directions, viz. on the basis of the realization that the ultimate requirement is just a relative movement between the workpiece and the press cylinder and not necessarily a displacement of the workpiece relatively to a stationary cylinder. In a portal press designed according to that principle the tool could reach different points spaced in the longitudinal direction of the workpiece by successive displacement of the latter in that direction, the position of the press cylinder being maintained, whereas the necessary crosswise relative movement is attained according to an opposite principle, the workpiece is kept stationary and the press cylinder is moved transversely between the two end columns of the frame of the press. However, the requirement for a movable press cylinder results in a reduced capacity of the machine since, in such a case, the hydraulic oil connections must be constituted by flexible hoses and as it is entirely unrealistic to give them such large effective cross-sectional areas which would be required for flows permitting rapid movements of the hydraulic piston. Another difficulty is that in such a design the piston is exposed to unsymmetric loads resulting in corresponding stresses on the piston and on the cylinder, which stresses in turn give strength problems but, above all, sealing problems. If the press is to operate with high press forces, which accordingly is equivalent to the use of a big and heavy hydraulic cylinder, the location of the cylinder at the upper yoke further leads to an increase of the height of the press gap which, in turn, on the one hand increases the total height of the machine and, on the other, results in stability problems. The latter are accentuated by the requirement for the hydraulic cylinder to be displaceable and by the just-mentioned risks of eccentric loads.

The main object of the invention is to provide a portal press in which the limitations and disadvantages above discussed have been extensively eliminated. More particularly, the main object of the invention is simultaneously to realize the apparently incompatible requirements for, on the one hand, a stationary location of the cylinders of the hydraulic equipment relatively to the press frame work and, on the other, a possibility for the press tools to reach the workpiece along all of the press gap.

The just-mentioned and other objects of the invention have, according to its main characteristic, been realized by location of the hydraulic equipment controlling the relative movements of the press tools on a stationary part of the press frame work in such a way that the two yokes are movable relatively to each other.

According to a preferred embodiment of the invention the hydraulic equipment is located at or inside the lower yoke, the portal formed by the two columns and by the upper yoke being in its entirety movable in relation to the lower yoke.

In accordance with a further characteristic of the invention at least one of the yokes carries a press tool movable in the longitudinal direction of the yoke, i.e. crosswise through the press gap.

The invention will now be described in greater detail, reference being made to the accompanying drawing illustrating a few embodiments thereof.

Figure 4:
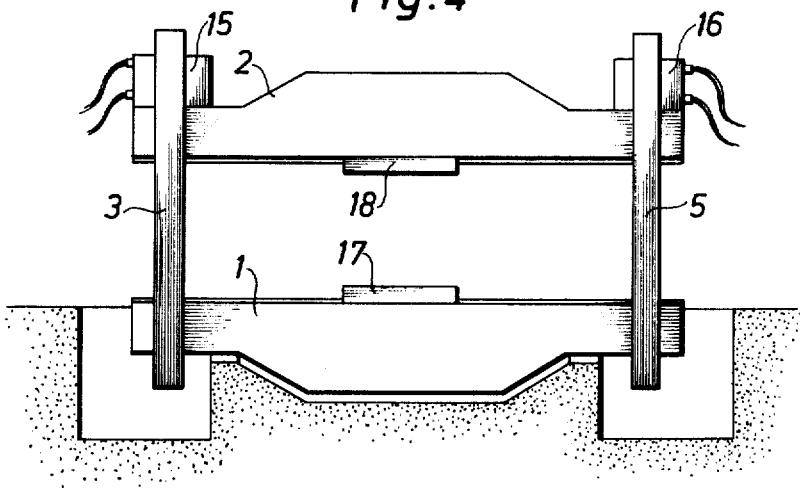

FIG. 4 refers to an embodiment according to which the upper yoke is movable relatively to the remaining part of the framework.

Figure 5:
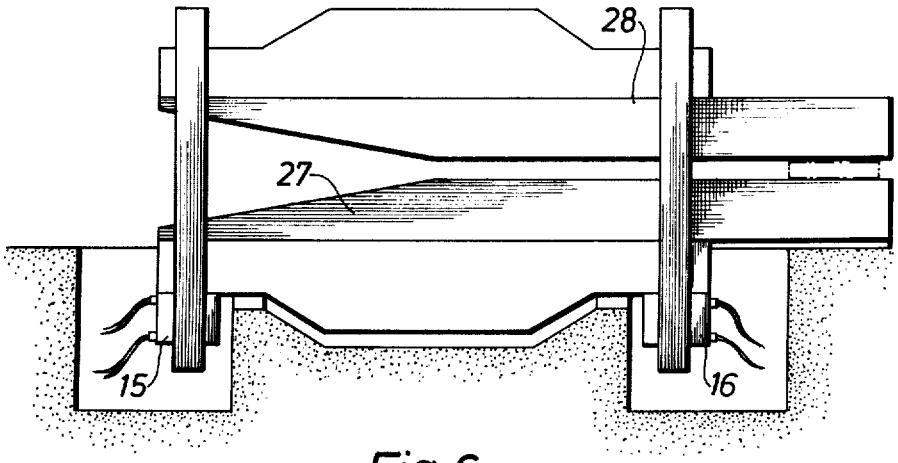
Figure 6:
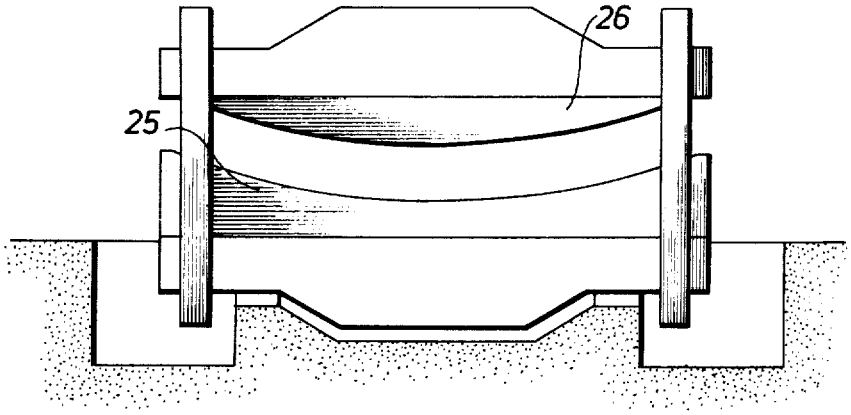

FIGS. 5 and 6 illustrate different tool arrangements.

Figure 7:
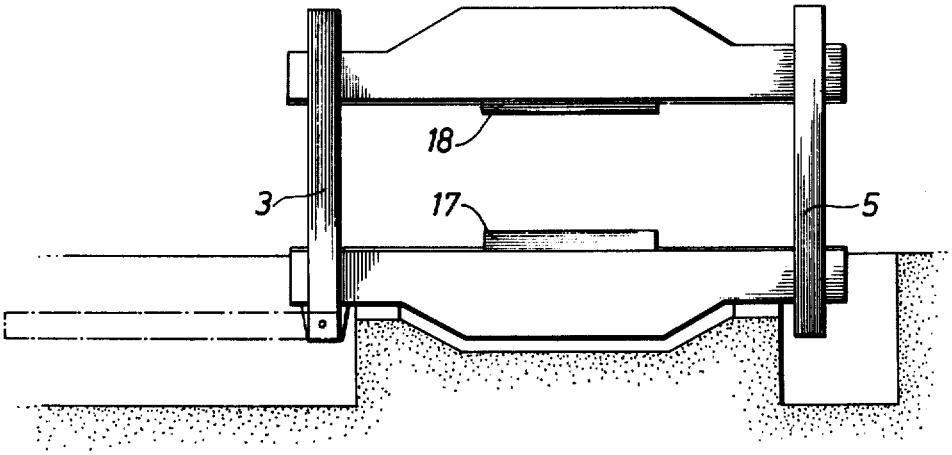

FIG. 7 shows a press framework comprising two pairs of twin columns the one pair of which is tiltable.

Figures 2, 3:
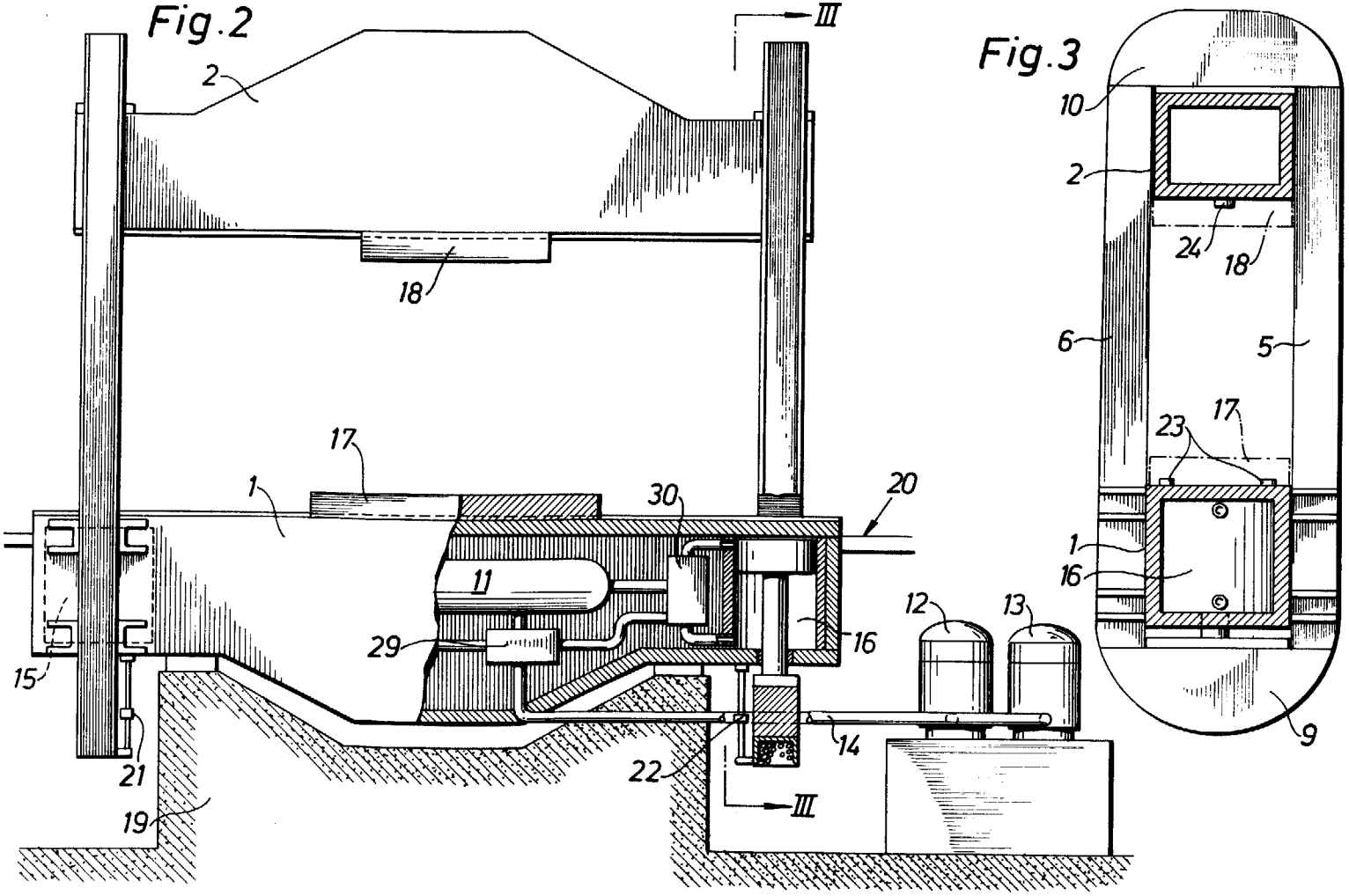
FIG. 2 is a part-sectional front view of the press shown in FIG. 1.
FIG. 3 shows a section taken along line III—III in FIG. 2.

The press illustrated on the drawing consists of a lower yoke 1 and an upper yoke 2, which together with two pairs of columns 3, 4 and 5, 6, respectively, form the frame of the press. At each end of the frame there are consequently two columns, joined at their bottom and top ends by cross-pieces 7, 8 and 9, 10, respectively, so that each column pair forms a circumferentially closed frame unit. That unit is preferably, in a manner known per se, provided with a reinforcement winding consisting of tension-biassed steel wires. FIG. 2 illustrates that each of yokes 1 and 2 is of tubular, or boxshaped, cross section. It is, however, most important to note that top yoke 2 together with columns 3–6 forms a portal, which is movable in vertical direction relatively to the bottom yoke 1. The corresponding movement is effected by means of a hydraulic equipment the components and operation of which will be described below. It should also be noted that the portal just referred to is composed by rigidly interconnected portions.

Figure 1:
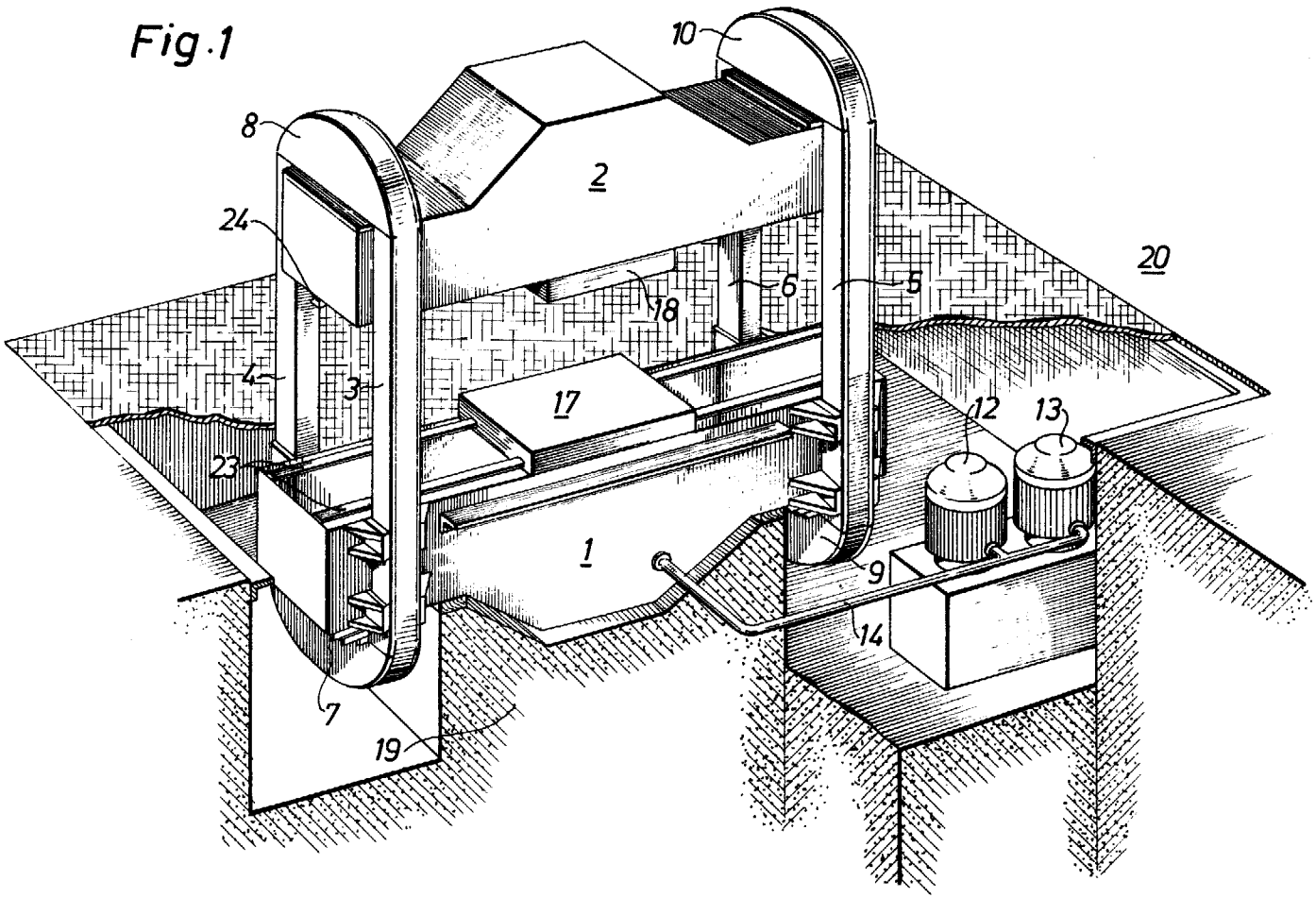
FIG. 1 is a perspective view of a press according to a first embodiment.

The bottom yoke 1 encloses a hydraulic pressure accumulator 11 with the aid of which the portal can be rapidly reciprocated between its passive position and its working position. The pressure-generating parts of the hydraulic system relied upon for effecting the working stroke proper consist of two hydraulic pumps 12 and 13, which, according to the embodiment here illustrated, are mounted outside the press frame and connected to the hydraulic system of the press over pressure pipe 14. Reference numerals 15 and 16 refer to two double-acting hydraulic cylinders, which can be connected to the hydraulic pumps 12, 13 — either directly or via the pressure accumulator. The corresponding switching may be carried out by means of a two-way valve 29. Numeral 30 designates a second two-way valve for switching between upward and downward movement of the portal. The pressure accumulator is relied upon for rapid movement of the portal, both from its upper resting position down to the position in which the pressing operation proper is initiated and for the return of the portal to the just-mentioned resting position. Accordingly, the hydraulic cylinders can be utilized for causing a relative movement between the portal 2–6 and yoke 1, which is equivalent to a relative movement between the tool holders, or press tables, 17 and 18 carried by yokes 1 and 2 respectively. For the purpose of accommodating the downward movement of the columns all of the press frame is mounted on an elevated base 19, which in turn is at a lower level than the floor 20 of the locality in which the press is installed. The upper surface of yoke 1 should preferably be substantially level with the floor as has been indicated in FIG. 1. The necessary synchronization of the hydraulic cylinders can be carried out in the conventional manner, i.e. by means of position signal transmitters 21, 22 the output signals of which are compared, suitably by means of an electrical circuit. When that circuit generates a differential signal, the latter is fed back to the hydraulic system for the purpose of compensating for the position difference as called for.

Each of the two tool holders 17, 18, which can be provided with different tools, is displaceable in the longitudinal direction of their respective yokes by being mounted in guides 23 and 24 — cf. FIG. 3. It is accordingly seen that the hydraulic system of the press here described does not comprise any hoses or other flexible connections.

It should be apparent from the above description of the construction of the press and from the drawing that the invention provides an optimized solution of the problems discussed in the introduction of the specification. Thus, the difficulty in handling the workpiece has been reduced to only a requirement for longitudinal displacement of the workpiece through the portal, a task which is relatively simple in the context, especially since the need for coordinate control has been eliminated. This makes it feasible to use a handling device which is much simpler and much less voluminous. Further, for a given width of the workpiece, the length of the press has been reduced to about half the value necessary in prior art presses. This has been made possible thanks to the fact that the distance, as messured in the longitudinal direction of the yokes, between the inner sides of the columns does not any more have to equal the double width of the workpiece but can, in principle, be equal to that width. Finally, if a comparison is made with such prior art presses, which have a completely rigid frame and working cylinder displaceable inside that frame, it can be established that the limitations and drawbacks have been eliminated which stem from a low hydraulic flow capacity, from risk of eccentric loads on the hydraulic cylinders, from sealing problems at the cylinders, and from the need of a high framework.

In summing up, the inventive concept can be defined as calling for a combination of two factors. The first factor is the use of mutually movable yokes the relative movement of which corresponds to the working stroke of the press. The second factor is the presence of tools, or tool holders, which are longitudinally displaceable along the yokes and which remain in unaltered position relatively to the yokes carrying them. This is, as far as horizontal movement is concerned, true at least during each working cycle and, as far as vertical movements are concerned, also in the intervals between such working cycles. It follows from that definition that the invention can be modified in terms of great deviations from the examples illustrated in FIGS. 1 and 2.

FIG. 4 illustrates an embodiment, according to which the hydraulic system is located at the top ends of the columns. However, the hydraulic system is stationary also in this case. When a working stroke is to be carried out the upper yoke is, by the hydraulic cylinders forced downwards whereas the other parts of the frame remain stationary. It is also possible to mount the hydraulic cylinders in diagonal positions, i.e. to place one of them at the one end of the upper yoke and the other at the opposite end of the lower yoke. Such a mounting increases the stiffness of the frame and facilitates the shifting of tools. The frame of a press according to that embodiment can accordingly be looked upon as being composed by two L-shaped halves instead of comprising one U-shaped and one I-shaped portion.

The press shown in FIG. 6 comprises tools 25, 26 extending along the full length of the yokes. According to the embodiment of FIG. 5 tools 27 and 28 project beyond the yokes. Thanks to the special configuration of the columns — cf. e.g. FIGS. 1 and 3 — it is very convenient to mount and demount the tools by passing them between the two legs of the column unit i question. The purpose of having the tool ends projecting outwards as shown in FIG. 5 is to make it possible alternatively to use the press as a gap press, naturally at reduced press forces. It is, however, possible to reinforce the projecting tool ends by letting the yokes proper support them also outside the columns.

Another advantage of the use of frame-shaped column units is illustrated in FIG. 7. As shown therein, one of the frame units is arranged to be tilted outwards and downwardly. In this way it becomes feasable to use the press also on workpieces having a circumferentially closed, e.g. annular, configuration. Before the pressing operation is initiated the column unit must naturally be swung back into its normal upright position.

In addition to the advantages of the invention above already discussed it is worth mentioning that thanks to the location of the hydraulic system spaced from tools and tool tables, namely inside or close to one of the yokes, the hydraulic cylinders are effectively protected from contamination and also from being heated by the workpiece, primarily through radiation but also through conduction. Another advantage of this location is that service work on the cylinders is facilitated and also that they are protected from mechanical damages.

What is claimed is:

1. An hydraulic press for heavy workpieces, comprising:

a frame including two spaced yokes (1, 2); and frame units, each frame unit including a pair of columns (3, 4 and 5, 6) disposed at the ends of the yoke and spacing the yokes apart, said pairs of columns (3, 4 and 5, 6) straddling the ends of the yokes (1, 2); and upper and lower cross-beams (7-10) interconnecting the columns of a pair of columns; and hydraulic cylinders (15, 16) carried by the frame and operatively coupled to at least one of the yokes (1, 2) to effect a working stroke of the press by relatively moving the yokes (1, 2) towards and away from each other;

at least one of the yokes (2) being provided with tool carrying means to carry a tool which is displaceable beyond the yoke in the longitudinal direction of the at least one yoke (2) so that said press is usable as a gap press.

2. A press according to claim 1 wherein said frame units each further comprise tension-biassed steel wire windings wound therearound.

3. A press according to claim 1 wherein said frame units have openings between the respective columns thereof, and wherein said tool means is adapted to carry a tool which is movable through the openings defined by said columns of said frame units.

4. A press according to claim 1 wherein at least one of said frame units (3, 4 and 7, 8) is detachable from the remaining portion of the press frame to facilitate operating on large annular workpieces.

* * * * *